US006915652B2

(12) United States Patent
Lane et al.

(10) Patent No.: US 6,915,652 B2
(45) Date of Patent: Jul. 12, 2005

(54) SERVICE CASE

(75) Inventors: Mark Lane, Acworth, GA (US); Michael B. Davidson, Mississauga (CA); Yakov Arshansky, Conyers, GA (US); David K. Hinde, Rex, GA (US); Richard N. Walker, Monroe, GA (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 10/804,627

(22) Filed: Mar. 19, 2004

(65) Prior Publication Data

US 2004/0244396 A1 Dec. 9, 2004

Related U.S. Application Data

(63) Continuation-in-part of application No. 10/223,760, filed on Aug. 19, 2002, now abandoned, and a continuation-in-part of application No. 10/222,767, filed on Aug. 17, 2002.

(60) Provisional application No. 60/351,265, filed on Jan. 23, 2002, and provisional application No. 60/314,196, filed on Aug. 22, 2001.

(51) Int. Cl.[7] ..... A47F 3/04

(52) U.S. Cl. ..... 62/246; 62/234; 62/276; 62/440

(58) Field of Search ..... 62/246, 276, 234, 62/333, 251, 257, 434, 435, 440

(56) References Cited

U.S. PATENT DOCUMENTS

| | | | | | |
|---|---|---|---|---|---|
| 2,136,232 | A | * | 11/1938 | Bromann, Jr. | 62/89 |
| 2,328,186 | A | | 8/1943 | Brace et al. | |
| 2,379,885 | A | | 7/1945 | Davis | |
| 2,382,599 | A | * | 8/1945 | Blair | 62/249 |
| 2,607,204 | A | | 8/1952 | Kleist | |
| 2,973,631 | A | * | 3/1961 | Adkins | 62/246 |
| 3,360,953 | A | | 1/1968 | Dieckmann | 62/249 |
| 4,135,369 | A | * | 1/1979 | Allgeyer et al. | 62/251 |
| 4,977,754 | A | * | 12/1990 | Upton et al. | 62/248 |

(Continued)

FOREIGN PATENT DOCUMENTS

| | | | |
|---|---|---|---|
| CH | 427 866 | | 1/1967 |
| CH | 440 349 | | 7/1967 |
| EP | 0 675 331 | | 10/1995 |
| EP | 0 602 911 | B1 | 5/1998 |
| EP | 1 134 514 | | 9/2001 |
| EP | 1 139 041 | A3 | 9/2002 |
| JP | 408024092 | A * | 1/1996 |
| JP | 411230663 | A * | 8/1999 |

OTHER PUBLICATIONS

European Patent Office, Supplementary European Search Report, EP 02 79 7743, Oct. 12, 2004 (2 pages).

U.S. Appl. No. 10/222,767 titled "Refrigeration System" filed Aug. 17, 2002 (77 pages).

(Continued)

*Primary Examiner*—William E. Tapolcai
*Assistant Examiner*—Mohammad M. Ali
(74) *Attorney, Agent, or Firm*—Foley & Lardner LLP

(57) ABSTRACT

A system for refrigeration of products includes a case having a compartment defining a space configured to receive the products. A first heat exchanger is configured to cool a fluid communicating with the space to cool the objects. A second heat exchanger is configured to receive a heat supply from an air source to warm the fluid. At least one coolant supply line and at least one coolant discharge line are configured to direct the fluid in communication with the space.

36 Claims, 6 Drawing Sheets

U.S. PATENT DOCUMENTS

| | | | | | |
|---|---|---|---|---|---|
| 5,217,064 | A | | 6/1993 | Kellow et al. | |
| 5,277,486 | A | * | 1/1994 | Bustos | 312/125 |
| 5,335,508 | A | | 8/1994 | Tippmann | |
| 5,351,498 | A | | 10/1994 | Takahashi et al. | |
| 5,381,670 | A | * | 1/1995 | Tippmann et al. | 62/330 |
| 5,598,886 | A | | 2/1997 | Criado-Mellado | |
| 5,649,432 | A | | 7/1997 | Cavalea, III | |
| 5,722,254 | A | | 3/1998 | Roth et al. | |
| 5,727,393 | A | | 3/1998 | Mahmoudzadeh | |
| 5,819,549 | A | * | 10/1998 | Sherwood | 62/246 |
| 5,887,440 | A | | 3/1999 | Dube | |
| 6,148,634 | A | | 11/2000 | Sherwood | |
| 6,155,075 | A | | 12/2000 | Hanson et al. | |
| 6,185,951 | B1 | * | 2/2001 | Lane et al. | 62/246 |
| 6,202,432 | B1 | * | 3/2001 | Haasis | 62/258 |
| 6,259,067 | B1 | * | 7/2001 | Faries et al. | 219/428 |
| 6,560,842 | B1 | * | 5/2003 | Kusel et al. | 29/455.1 |
| 6,647,735 | B2 | | 11/2003 | Street et al. | |
| 6,684,650 | B2 | | 2/2004 | Weyna et al. | |
| 6,698,234 | B2 | | 3/2004 | Gopalnarayanan et al. | |
| 6,705,093 | B1 | | 3/2004 | Taras et al. | |
| 6,722,149 | B1 | | 4/2004 | Saroka et al. | |
| 6,745,588 | B2 | | 6/2004 | Kahler | |
| 6,755,042 | B2 | | 6/2004 | Chuang et al. | |
| 2001/0027663 | A1 | | 10/2001 | Zeigler et al. | |
| 2004/0067290 | A1 | | 4/2004 | Swofford et al. | |
| 2004/0069002 | A1 | | 4/2004 | Chuang et al. | |
| 2004/0088069 | A1 | | 5/2004 | Singh | |
| 2004/0123613 | A1 | | 7/2004 | Chiang et al. | |

OTHER PUBLICATIONS

U.S. Appl. No. 10/223,759 titled "Service Case" filed Aug. 19, 2002 (19 pages).

U.S. Appl. No. 60/351,265 titled "Refrigeration System" filed Jan. 23, 2002 (28 pages).

U.S. Appl. No. 60/314,196 titled "Service Case" filed Aug. 22, 2001 (7 pages).

SNOPAN® STEEMPAN® COLPLATE® and other units for efficient, flexible and reliable food display, serving & storage, Tranter, Inc., having a date indication of "Sep. 1994", 4 pages (best available copy).

* cited by examiner

SERVICE CASE

CROSS-REFERENCE TO RELATED PATENT APPLICATIONS

The present Application is a continuation in part of the following U.S. Patent Applications: U.S. application Ser. No. 10/223,760, titled "Service Case" led Aug. 19, 2002 now abandoned; and U.S. patent application Ser. No. 10/222,767, titled "Refrigeration System" filed Aug. 17, 2002.

The present Application claims the benefit of priority as available under 35 U.S.C. §§ 119(e) and 120 of the following applications (which are incorporated by reference): U.S. application Ser. No. 10/223,760, filed Aug. 19, 2002, which claims the benefit of priority of U.S. Provisional Application No. 60/314,196, filed Aug. 22, 2001; and U.S. patent application Ser. No. 10/222,767, titled "Refrigeration System" filed Aug. 17, 2002, which claims the benefit of priority of U.S. Provisional Application No. 60/351,265 filed on Jan. 23, 2002 and U.S. Provisional Application No. 60/314,196, filed Aug. 22, 2001.

BACKGROUND

The present invention relates to a temperature controlled case of a type typically used for storage and display of chilled and/or frozen products, such as a store environment.

A typical cooling coil in a refrigerated case is constructed of metal, such as copper or aluminum and is often noticeable when mounted in a refrigerated case. Case manufacturers try to conceal this coil by placing an attractive cover over the coil or placing the coil in a hidden location, such as under a product shelf. However, although these methods may hide the coil, they do not make the case particularly attractive and may affect refrigeration efficiency.

Shelves in refrigeration cases are typically made from painted metal or stainless steel and may be used to cover a forced air evaporator mounted beneath the shelf, or there may be a gravity type coil may be mounted above the shelving. In such applications, the actual cooling of the product is generally achieved from the gravity type coil mounted above the shelf or from the forced air coil mounted below the shelf, which has certain disadvantages.

Accordingly, it would be desirable to provide an improved temperature controlled case for storage and display of cooled and/or frozen products. It would also be desirable to provide a temperature controlled case which is efficient and esthetically pleasing. It would be further desirable to provide a temperature controlled case for use in a commercial store environment. It would be further desirable to provide a temperature controlled case having cooling devices above and below shelves for product storage. It would be further desirable to provide a temperature controlled case including gravity type coolant coils and gravity type louvers above the products and refrigerated pans beneath the product. It would be further desirable to provide a temperature controlled case including a defrost system for removing accumulated ice and frost from the gravity coils and refrigerated pans. It would be further desirable to provide a temperature controlled case including a defrost system configured to warm a coolant for circulation to the gravity coils and refrigerated pans. It would be further desirable to provide a temperature controlled case having a defrost system that uses air to warm the coolant for circulation to the gravity coils and the refrigerated pans.

Accordingly, it would be desirable to provide a temperature controlled case having any one or more of these or other advantageous features.

SUMMARY

One embodiment of the invention relates to temperature controlled case for storage and display of chilled or frozen products. The case includes at least one compartment for product storage, at least one access opening providing entrance to the compartment, at least one shelf within the compartment for holding the products and at least one cooling device above the shelf. A refrigeration system is operatively associated with the compartment to circulate a cooling medium through separate coolant supply and discharge lines to at least one of the cooling device and the shelf so that a desired temperature may be maintained within the compartment for storage of the products. A defrost system is configured to use ambient air to warm the cooling medium so that the warmed cooling medium may be circulated to defrost at least one of the cooling device and the shelf.

Another embodiment of the invention relates to a refrigeration device having a primary cooling system with a primary fluid communicating with a first heat exchanger and a secondary cooling system with a secondary fluid communicating with the first heat exchanger to cool the secondary fluid and communicating with at least one cooling device configured to provide cooling to a compartment to be cooled in a first mode of operation. The refrigeration device includes at least one coolant supply line and at least one coolant discharge line configured to circulate the secondary fluid through the at least one cooling device. A second heat exchanger communicates with the secondary cooling system and with a source of ambient air to warm the secondary fluid in a second mode of operation.

A further embodiment of the invention relates to a system for refrigeration of products. The system includes a case having a compartment defining a space configured to receive the products. A first heat exchanger is configured to cool a fluid communicating with the space to cool the objects. A second heat exchanger is configured to receive a heat supply from an air source to warm the fluid. At least one coolant supply line and at least one coolant discharge line are configured to direct the fluid in communication with the space.

DETAILED DESCRIPTION OF THE PREFERRED EMBODIMENTS

According to any preferred embodiment, the present invention provides a temperature controlled case for storage and display of chilled and/or frozen products. The temperature controlled case includes cooling devices shown as at least one cooling coil above the product and a cooling shelf (e.g. refrigerated pan, shelf, etc.) beneath the products, including separate coolant supply and discharge lines for circulating a coolant from a coolant supply source to the cooling devices (e.g. coil and refrigerated shelf, etc.). The temperature controlled case also includes a refrigeration system having a primary cooling system having a primary coolant (e.g. direct expansion refrigerant, etc.) is configured to provide cooling in a heat exchanger (e.g. chiller, etc.) to a cooling medium such as a liquid secondary coolant (e.g. water, glycol, etc.) that is circulated through the cooling devices for cooling the products and the air within the case. The coils above the product include gravity type cooling coils and gravity type louvers with drains and preferably lighting included with the louver assembly. The refrigerated shelf beneath the products may includes one or more separate sections for holding the products. A defrost system is configured to warm the secondary coolant for circulation to at least one of the coil and the shelf.

Figure 1:
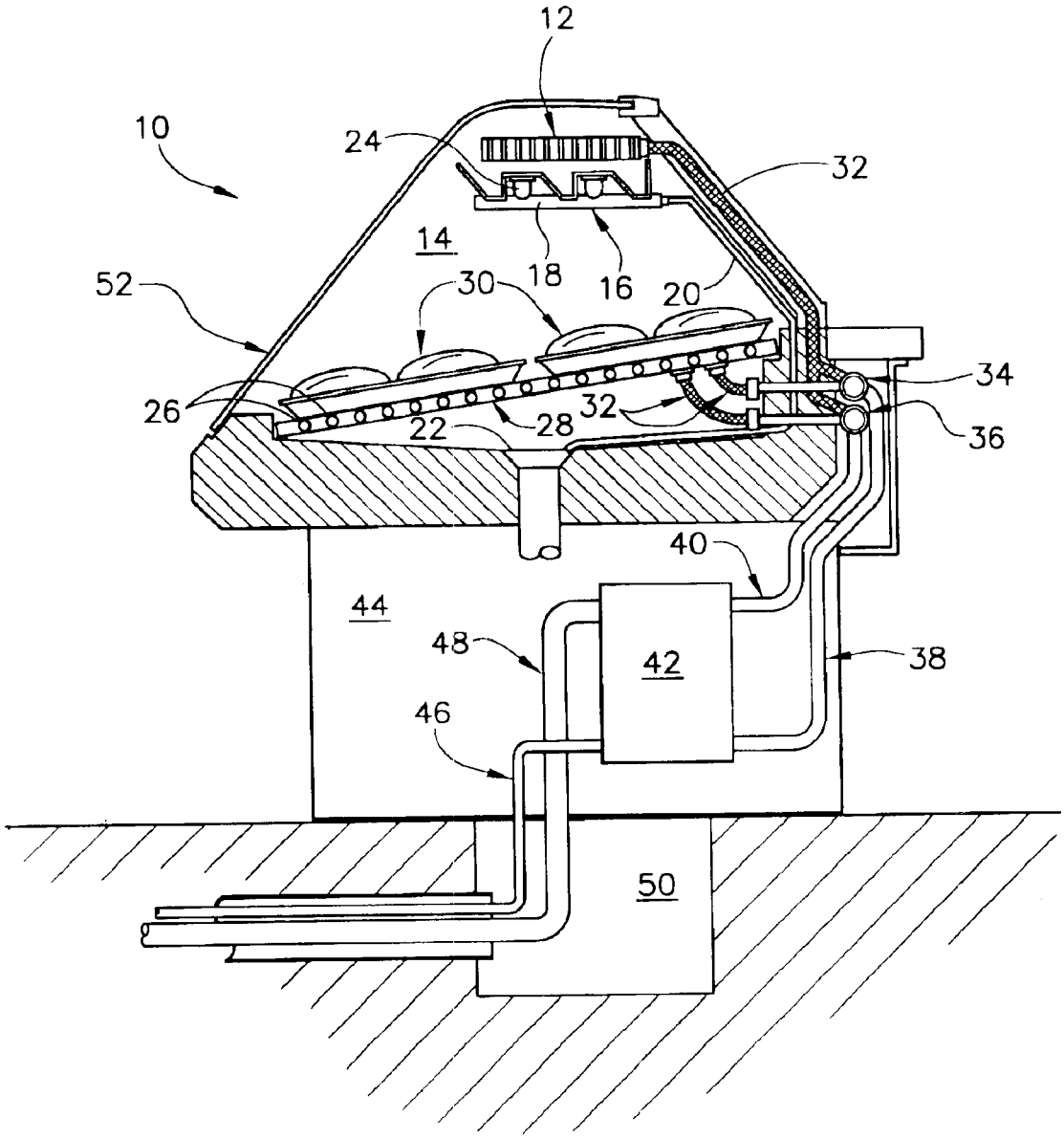
FIG. 1 is a schematic cross-sectional view of a representative service case according to an embodiment of the present invention.

FIG. 1 shows a cross-section of a temperature controlled case 10 according to an embodiment of the present invention. A secondary coolant gravity coil 12 is situated near the top of the refrigerated space 14. Mounted below coil 12 is a gravity louver assembly 16 which is designed to both direct air flow through the refrigerated space and catch water falling from the coil above from condensation or melting during defrost cycles. A drain pan 28 directs the flow of water from louvers 16 into piping 20 connected to a main case drain 22. Louver assembly 16 may also contain an integrated lighting system 24 to better illuminate the products.

Secondary coolant is circulated inside refrigerated pans or shelf 28 (e.g. through channels 26, etc.) which provide cooling. Pans or shelf 28 may be insulated on their underside to prevent heat transfer to the unused space below. Above the pans or shelf, the products 30 are shown placed in containers, desirably made of a metallic or otherwise heat-conductive material. Secondary coolant flows to and from cooling coils 12 and to and from the refrigerated shelf or pans 28 inside of flexible hoses 32 which may be equipped with valved quick-disconnect fittings to facilitate removal of the coils or shelf for cleaning or other maintenance.

Coolant supply header 34 and coolant return header 36 are shown placed in the back of the case for connection to the coils 12 and shelf 28. Chilled secondary coolant flows into coolant supply header 34 through coolant supply line 38 and the secondary coolant flows out of coolant return header 36 through a coolant return line 40, both of which may either be connected to a packaged chiller 42 or a centralized chiller for multiple cases or the entire facility, for chilling the secondary coolant.

Packaged chiller 42 may consist of a pump to provide flow of coolant and a heat exchanger to provide heat flow from the secondary coolant to a primary coolant, preferably a volatile refrigerant. Additional equipment may also be included to facilitate temperature controls, safety devices, and to defrost the coils and pans.

Chiller 42 is shown contained within a pedestal base 44 and intended to be hidden from view of the customer. According to an embodiment where a direct expansion system already exists within a store, a refrigerant liquid line 46 and suction line 48 can provide flow of a primary refrigerant to the packaged chiller, such as through a passage, shown as a refrigeration pit 50, already existing in the floor.

According to any preferred embodiment, the service case of the present invention includes an openable door 52 of a conventional type for access to products 30.

According to any preferred embodiment, the refrigerated shelf and coil are refrigerated by pumping a chilled liquid (e.g. secondary coolant) through the shelf. The refrigerated shelf may be a single shelf or may be divided into smaller sections for removal and case cleaning. The refrigerated shelves are supplied with chilled liquid secondary coolant by a chilled liquid header system. The header system includes a chilled liquid inlet header and a chilled liquid outlet header. The shelves are shown connected to the header system via liquid-tight connectors that allow the refrigerated shelves to be disconnected from the chilled liquid headers, without losing substantial amounts of the chilled liquid secondary coolant.

Conventional case designs using one single refrigerated shelf or plate tend to have certain disadvantages (e.g. the plate is generally large and difficult to manufacture, cannot be readily removed for cleaning, the weight may be too great for store personnel to remove, multiple sizes would be needed based on the case size, etc.).

Figure 2:
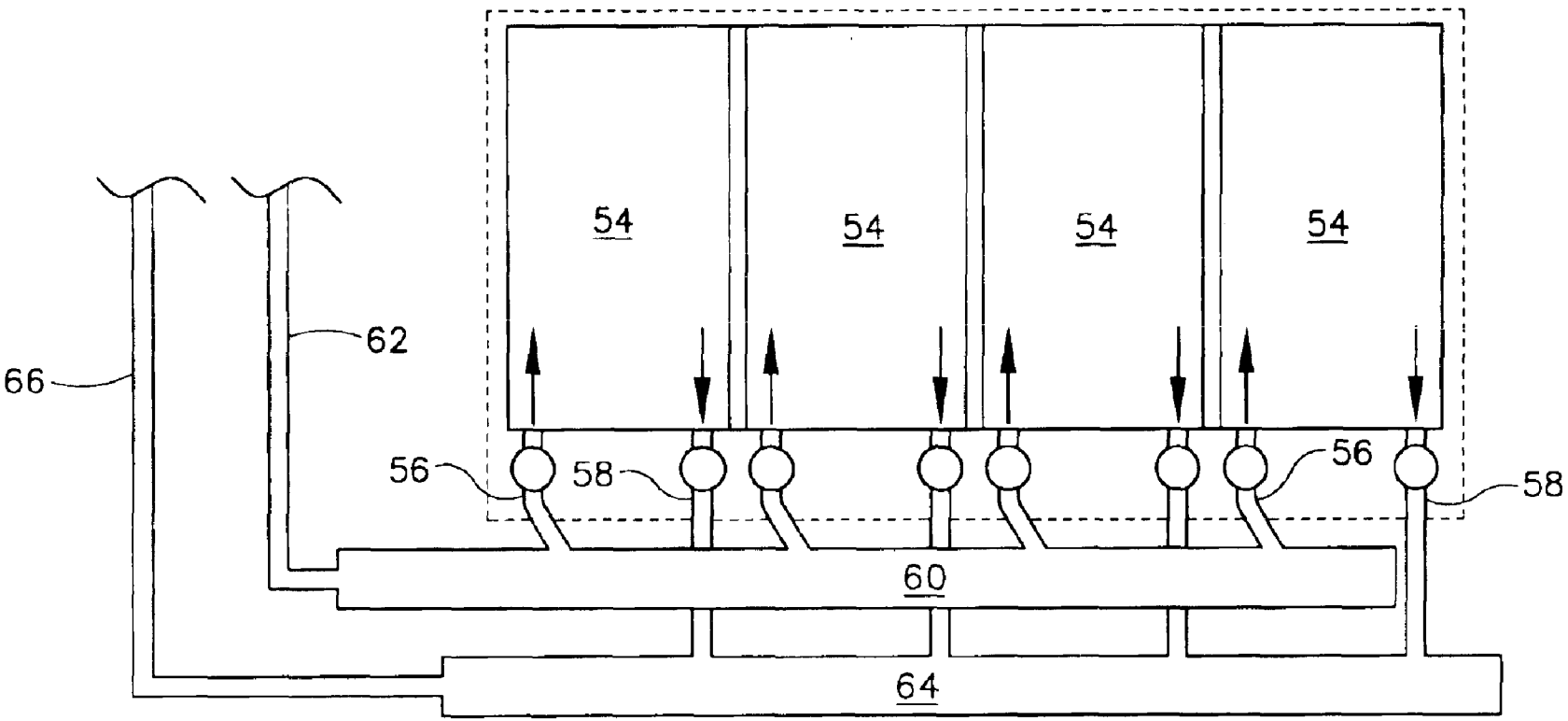
FIG. 2 is a schematic view of an inside bottom portion of a service case according to an embodiment of the present invention.

Referring to FIG. 2 the inside bottom of the case for a multi-plate design with separate inlets and outlets is shown for the refrigerated shelves according to an embodiment of the present invention. Multiple refrigerated shelves 54 are shown with secondary coolant liquid inlet lines 56 and secondary coolant liquid outlet lines 58. Inlet lines 56 are connected to coolant liquid inlet header 60, which is connected to chilled secondary coolant supply lines 62. Secondary coolant liquid outlet lines 58 are connected to secondary coolant liquid outlet head 64, which is connected to secondary coolant outlet supply line 66. The chilled secondary coolant liquid supply line is connected to a chilled secondary coolant liquid supply source (not shown).

Figure 3:
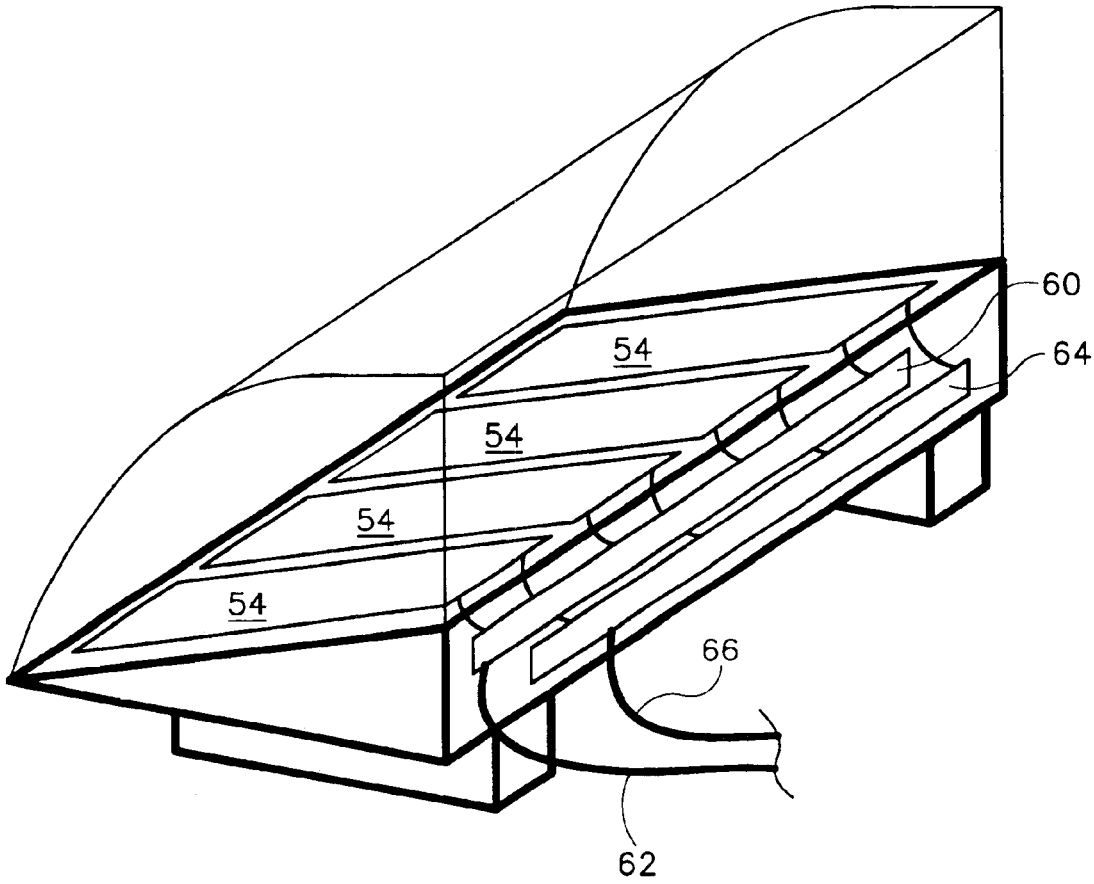
FIG. 3 is a schematic perspective view of a service case according to an embodiment of the present invention.
Figure 4:
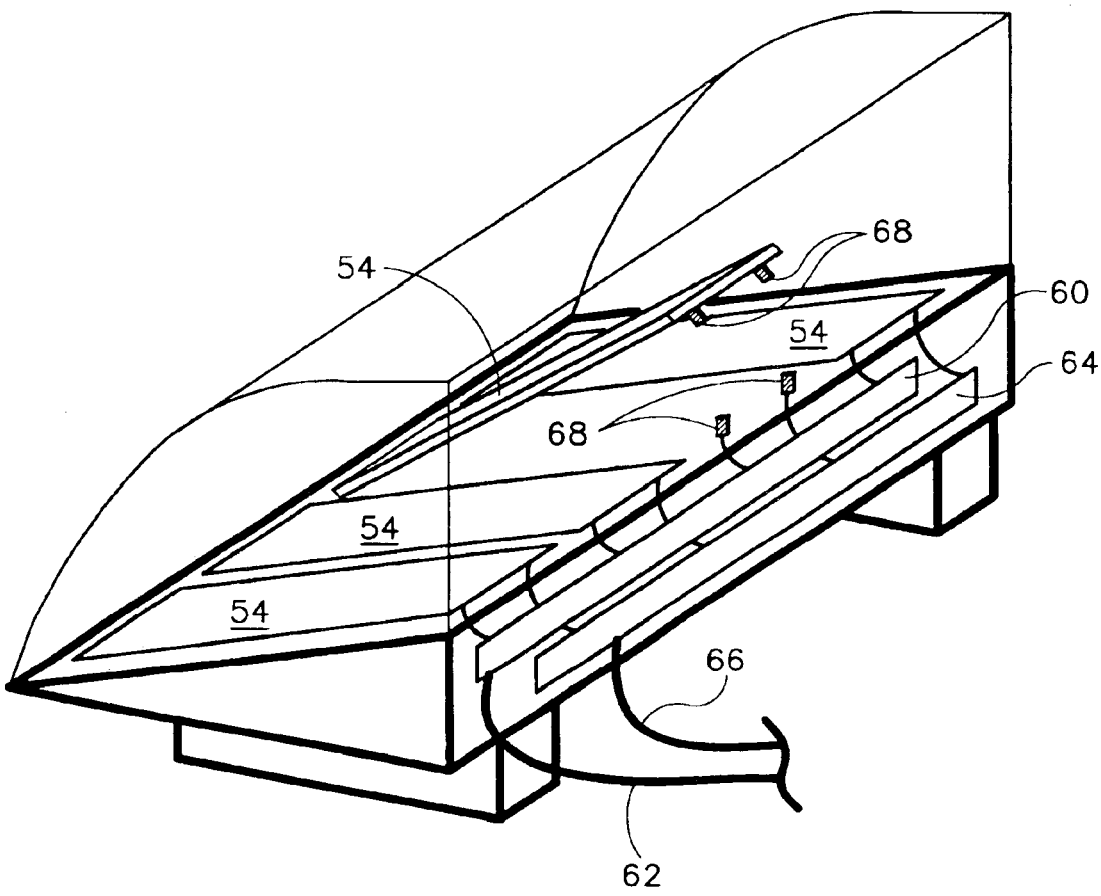
FIG. 4 is a schematic perspective view of the embodiment of FIG. 3 showing removal a section of the refrigerated shelf.

Referring to FIGS. 3–4 the multi-plate design of the refrigerated shelf is shown installed and with the removal of one plate. For convenience, the upper plates are not shown. FIG. 3 shows for example, the refrigerated shelf with four separate shelf sections (also shown in FIG. 2).

Referring to FIG. 4, one of the refrigerated shelf sections is shown disconnected from secondary coolant liquid headers 60, 64 via low liquid loss connectors 68. Connectors 68 are intended to facilitate removal of the liquid filled shelves by store personnel without spilling large amounts of the secondary coolant liquid. As shown for example in FIGS. 3 and 4, the refrigerated shelves are divided into four separate sections, permitting smaller and lighter subsections of shelving.

Figure 5:
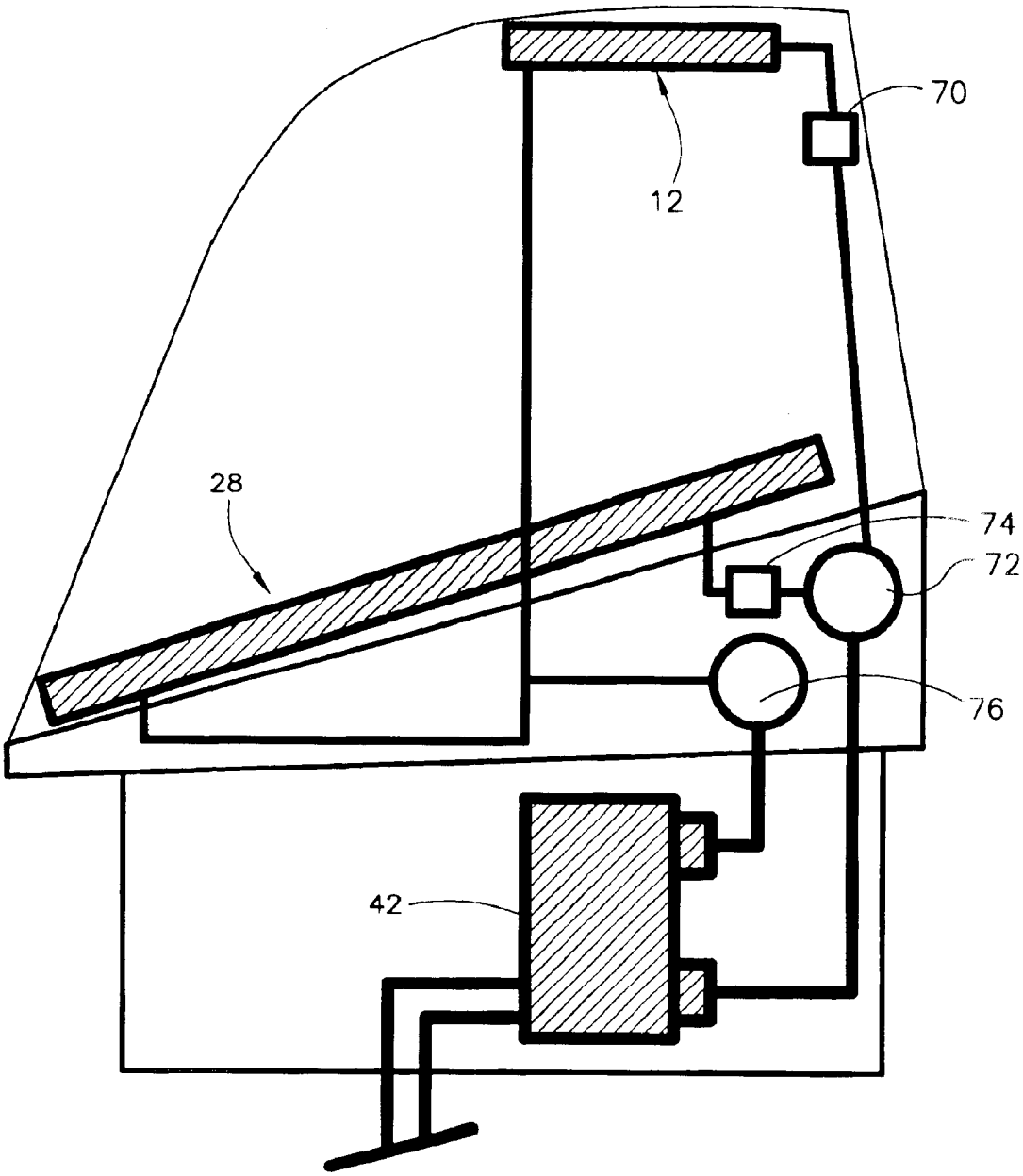
FIG. 5 is a schematic cross-sectional view showing various components of a refrigerated case according to an embodiment of the present invention.

Referring to FIG. 5, a control system for controlling the temperature of the coil separately from the temperature of the refrigerated shelf or pan is shown according to an embodiment of the present invention. The control system provides for restricting the flow of chilled secondary coolant liquid to the coil 12 or refrigerated shelf or pans 28 via a flow control device (e.g. liquid stop solenoid, flow regulator, flow valve, orifice, electronic valve, change in line size or diameter, etc.). When the flow rate of the chilled secondary coolant liquid is slowed through the refrigerated shelf or coil, the temperature will tend to rise, when the flow rate of the chilled secondary coolant liquid is increased, the temperature will tend to decrease. The control system is configured to provide control of the coil separately from the refrigerated shelf in order to increase humidity in the case, and for the purpose of defrosting the coil or refrigerated pan at different times and duration.

In order to control the coil separately from the refrigerated shelves, flow regulators 70 are shown installed between a chilled secondary coolant liquid supply header 72 and the coil 12. Another flow regulator 74 is shown installed between chilled secondary coolant liquid supply header 72 and the refrigerated shelves 28. According to an alternative embodiment, one flow regulator could be piped directly to the chilled secondary coolant liquid supply header with only one item having a flow regulator valve installed, so that one item (e.g. the refrigerated shelves) may be controlled based on the temperature of the chilled secondary coolant liquid supply header while the other item (e.g. the coil), may be controlled separately. With the refrigerated shelves being controlled by the temperature of the chilled secondary coolant liquid supply header, the coil will enter a defrost stage with the shelves. With separate flow regulating devices, the coil and refrigerated shelves are configured to be defrosted separately. Referring further to FIG. 5 the piping system of the case is shown according to an embodiment of the present invention. The piping is shown to interconnect coils 12, refrigerated shelf 28, flow regulators 70, 74, chilled secondary coolant liquid supply header 72, secondary coolant liquid return header 76 and chiller 42.

During operation of the case, it is desirable to improve the precision in controlling the temperature of the products. The products are typically expensive, perishable items, and are typically required to be maintained within a temperature range mandated by an appropriate authority (e.g. the U.S. Food and Drug Administration). Therefore, the dual temperature control provided by the control system of the present invention allows flexible temperature control of the products within the case during normal operation.

According to a preferred embodiment, when the case is in a refrigerating mode the temperature of the refrigerated shelf will be controlled at the temperature desired for the products. According to one example, if the product was fresh beef, the temperature of the refrigerated shelf may be set at 30 degrees F. Because the fresh meat sits directly on the refrigerated shelves, the temperature of the meat will tend be held at 30 degrees F. The temperature of the coil may then be controlled at 28 degrees F. to maintain the temperature of the air in the case. The Applicants believe that by setting the temperature of the refrigerated shelves higher than the temperature of the coil, a very slow convection cooling effect will occur inside the case, causing very slow air movement over the product.

In addition to controlling the temperature of the air, when cycling the flow regulator to the coil based on the actual temperature of the coil, the Applicants believe that control of the amount of moisture being removed from the case can be improved. In a typical cases of a conventional type, a top coil is controlled to maintain product temperature. In contrast, according to any preferred embodiment of the case design of the present invention, the temperature of the product is mostly controlled by controlling the flow regulator to the refrigerated shelf, which permits the top coil to be controlled based on the temperature of the coil and the air in the case, which is believed to directly affect the humidity of the air within the case.

Controlling the humidity of the air within the case is desirable because products, such as fresh meat, seafood, etc. may need to maintain a high moisture level. In the case of fresh beef, the weight, look, and freshness of the beef are often determined by the liquid content of the beef. In the event that a coil operates at a very low temperature (such as in conventional cases) the coil tends to build an increased frost level. The frost is believed to result primarily from two sources. The first source is the operating environment, such as the humidity level in the building the case is installed in. The second source is the moisture content of the product (e.g. fresh meat, etc.). When the product, such as fresh meat, loses moisture in the form of frost on the coil, the product loses weight and tends to appear "dry." The weight loss affects the profits from the sales of the product and the "dry" appearance of the product tends to affect a customer's desire to buy the product.

The control system of the present invention is intended to improve the control of the temperature of the coil using a flow regulator, so that a higher humidity level in the case may be maintained, and is intended to retain more of the moisture in the product, rather than permitting the moisture to accumulate into frost on the coil. The ability to control the temperature of the bottom shelves and maintain the temperature of the products by cycling the flow regulator to the shelf, permits the coil to be maintained at a separate and desired temperature level.

In a typical case of a conventional type, the case enters defrost and stops defrosting as one unit, i.e. all coils and refrigeration devices enter defrost at the same time, causing the temperature of the product to rise until the defrost cycle has ended. Then the temperatures of the case and the product are "pulled down" to the level of normal operation. This periodic rise in the temperature of the products tends to affect the product's life, color and bacterial growth.

According to any preferred embodiment of the present invention, the coil may be defrosted, while still providing chilled secondary coolant to cool the refrigerated pans. Next the refrigerated pans can be defrosted while the coil is remains refrigerated. Defrosting the coils and refrigerated pans separately permits the product to be continuously cooled by at least one cooling device, while the frost level is being reduced on the other. Although reducing the frost level is necessary in refrigerated case applications to maintain case performance and cooling capacity, the temperature change of the product during a defrost cycle is minimized when the product is continuously receiving cooling from at least one of the cooling devices.

In addition to defrosting the cooling devices at different times, the defrost times and duration of the cooling devices can vary. For example, in cases where the refrigerated shelves or pans are not as affected by frost as the coil, the coil can be defrosted more times a day than the refrigerated pans. Reducing the total amount of defrosts cycles tends to improve the ability to maintain the temperature of the product.

Figure 6:
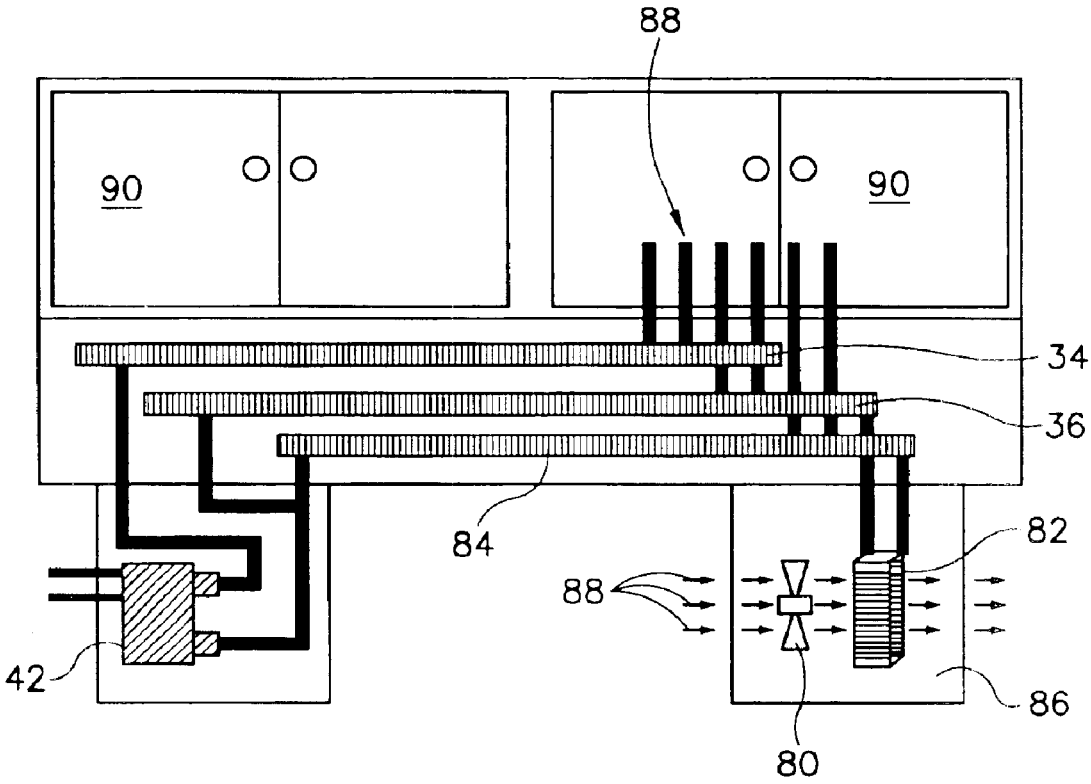
FIG. 6 is a schematic rear view of a refrigerated case according to an embodiment of the present invention.

Referring to FIG. 6 which shows a rear view of a case, a heat exchanger is provided for using store ambient air to generate warm fluid at the case to defrost the coil and refrigerated pans, according to an embodiment of the present invention. In cases of a conventional type, hot gas or an electric heater is used to generate heat in the case to defrost the coils. Such conventional cases typically use direct expansion type systems, using only a refrigerant gas. Since the design of the present invention uses a secondary cooling loop that pumps a chilled secondary coolant liquid, such as glycol or water, it would be desirable to defrost the coils, without use of a hot gas or electric heater. To generate a warm liquid, the defrost system according to an embodiment of the present invention includes a fan 80, a coil 82 and a warm liquid defrost header 84.

During a defrost cycle, the warm liquid will be pumped from the warm liquid defrost header 84 through the coil and/or refrigerated pans. The warm liquid is intended to quickly defrost the cooling device by removing all frost from the device.

The defrost system comprises air cooled coil 82, fan 80, warm liquid defrost header 84 and all associated valves needed to bypass the chilled liquid that is normally sent to the top coil and pans. During a defrost cycle for a cooling device, the chilled liquid will be replaced with the fluid warmed by coil 82 and fan 80 and routed through warm liquid defrost header 84 to thaw frost from coil 12 and/or refrigerated pans 28.

According to a preferred embodiment, the liquid is warmed using the ambient air 88 from the store environment. According to an alternative embodiment, generating warm liquid for defrost may be conducted in the store's machine room using a plate-type heat exchanger and suitable valves and equipment. According to another alternative embodiment, warm liquid for defrost could be generated using a small holding tank with heating coils an electric heater.

Referring further to FIG. 6, chiller 42 is connected to chilled secondary coolant liquid supply header 34 and secondary coolant liquid return header 36 which are connected to piping 88 for circulating the coolant to the coils and refrigerated shelves (not shown in FIG. 6). Doors 90 are shown to provide access to the case. Warm liquid defrost header 84 is shown connected to coil 82.

It is important to note that the construction and arrangement of the elements of the temperature controlled case with a defrost system using ambient air provided herein are illustrative only. Although only a few exemplary embodiments of the present invention have been described in detail in this disclosure, those skilled in the art who review this disclosure will readily appreciate that many modifications are possible in these embodiments without materially departing from the novel teachings and advantages of the invention. Accordingly, all such modifications are intended to be within the scope of the disclosure.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the inventions as expressed in the appended claims.

What is claimed is:

1. A temperature controlled case for storage and display of chilled or frozen products comprising at least one compartment for product storage, at least one access opening providing entrance to the compartment, at least one shelf within the compartment configured for holding the products, at least one cooling device above the shelf, a refrigeration system operatively associated with the compartment and configured to circulate a cooling medium through separate coolant supply and discharge lines to at least one of the cooling device and the shelf so that a desired temperature may be maintained within the compartment for storage of the products, and a defrost system configured to use ambient air to warm the cooling medium so that the warmed cooling medium may be circulated to defrost at least one of the cooling device and the shelf.

2. The temperature controlled case of claim 1 wherein the shelf is divided into separate sections.

3. The temperature controlled case of claim 1 wherein the defrost system includes at least one valve configured to direct the flow of the warmed fluid to at least one of the cooling device and the shelf during a defrost mode of operation.

4. The temperature controlled case of claim 1 wherein the refrigeration system comprises a primary and secondary cooling system, where the primary cooling system is configured to chill the secondary cooling system and wherein the secondary cooling system is configured to provide the cooling medium to at least one of the cooling device and the shelf.

5. The temperature controlled case of claim 4 wherein the cooling medium is a liquid secondary coolant configured to flow through the cooling device and the shelf.

6. The temperature controlled case of claim 1 further comprising a louver device adjacent and beneath the cooling device and a drain extending from the louver device.

7. The temperature controlled case of claim 6 wherein the louver device includes lighting.

8. The temperature controlled case of claim 4 further comprising a chiller interconnected to the primary cooling system and the secondary cooling system.

9. The temperature controlled case of claim 2 including a coolant liquid inlet header connected to the shelf and a coolant liquid outlet header connected to the shelf.

10. The temperature controlled case of claim 9 further comprising connectors for connecting and disconnecting each shelf section to the headers.

11. The temperature controlled case of claim 1 further comprising a first flow regulator configured for supplying the cooling medium to the cooling device and a second flow regulator configured for supplying the cooling medium to the shelf.

12. The temperature controlled case of claim 11 including a chilled liquid supply header connected to the flow regulators.

13. The temperature controlled case of claim 3 wherein the defrost system includes a heat exchanger and a fan operative to use warm air from a store environment to warm the cooling medium.

14. The temperature controlled case of claim 1 wherein the defrost system comprises a fan and a coil configured to warm the cooling medium with air from a store environment.

15. A refrigeration device having a primary cooling system with a primary fluid communicating with a first heat exchanger and a secondary cooling system with, a secondary fluid communicating with the first heat exchanger to cool the secondary fluid and communicating with at least one cooling device configured to provide cooling to a compartment to be cooled in a first mode of operation, the refrigeration device comprising:

at least one coolant supply line and at least one coolant discharge line configured to circulate the secondary fluid through the at least one cooling device; and a second heat exchanger communicating with the secondary cooling system and communicating with a source of ambient air to warm the secondary fluid in a second mode of operation.

16. The refrigeration device of claim 15 wherein the first mode of operation is a refrigeration mode and the second mode of operation is a defrost mode.

17. The refrigeration device of claim 16 wherein the at least one cooling device comprises a shelf configured to support objects to be cooled within the compartment.

18. The refrigeration device of claim 17 wherein the shelf is divided into separate sections.

19. The refrigeration device of claim 17 wherein the at least one cooling device further comprises a cooling coil disposed above the shelf and the objects within the compartment.

20. The refrigeration device of claim 19 wherein the shelf is configured to operate in the refrigeration mode while the cooling coil is configured to operate in the defrost mode.

21. The refrigeration device of claim 19 wherein a frequency of operation of the cooling coil in the defrost mode is greater than a frequency of operation of the shelf in the defrost mode.

22. The refrigeration device of claim 19 further comprising a louver beneath the cooling coil, wherein the louver is configured to direct air flow through the compartment.

23. The refrigeration device of claim 15 wherein the source of ambient air is an air space in a store.

24. The refrigeration device of claim 15 wherein the at least one cooling device comprises a shelf having channels for circulating coolant through the shelf to provide contact cooling to objects supported in the shelf.

25. The refrigeration device of claim 24 wherein the shelf further comprises an insulation layer on an underside of the shelf.

26. A system for refrigeration of products comprising:

a case having a compartment defining a space configured to receive the products;

a first heat exchanger configured to cool a fluid communicating with the space to cool the objects;

a second heat exchanger configured to receive a heat supply from an air source to warm the fluid; and at least one coolant supply line and at least one coolant discharge line configured to direct the fluid in communication with the space.

27. The system of claim 26 wherein the air source is an ambient air source in a store.

28. The system of claim 26 wherein the cooled fluid is circulated to at least one cooling device communicating with the space during a refrigeration mode of operation and the warmed fluid is circulated to the at least one cooling device during a defrost mode of operation.

29. The system of claim 28 wherein the at least one cooling device comprises a shelf disposed in the compartment and a cooling coil disposed above the products.

30. The system of claim 29 wherein a frequency of the defrost mode of operation for the cooling coil is greater than a frequency of the defrost mode of operation for the shelf.

31. The system of claim 28 wherein a first cooling device is configured to operate in the refrigeration mode of operation while a second cooling device is configured to operate in the defrost mode of operation.

32. The system of claim 29 further comprising at least one flow regulating device configured to control the flow of the fluid to at least one of the cooling coil and the shelf.

33. The system of claim 32 wherein fluid is circulated to the cooling coil at a first flow rate and the fluid is circulated to the shelf at a second flow rate different from the first flow rate.

34. The system of claim 32 wherein the cooling coil is maintained at a first temperature and the shelf is maintained at a second temperature different from the first flow rate.

35. The system of claim 26 wherein the second heat exchanger is a fan-coil unit.

36. The system of claim 26 further comprising a louver assembly configured to direct a flow of air within the space.

* * * * *